US005376757A

United States Patent [19]

Marsh et al.

[11] Patent Number: 5,376,757

[45] Date of Patent: Dec. 27, 1994

[54] ELECTRICAL HARNESS SYSTEM

[75] Inventors: Michael J. C. Marsh, Johannesburg; Werner Bremer, Pretoria, both of South Africa

[73] Assignee: CSIR, South Africa

[21] Appl. No.: 815,773

[22] Filed: Jan. 2, 1992

[30] Foreign Application Priority Data

Jan. 4, 1991 [ZA] South Africa ..... 910076

[51] Int. Cl.[5] ..... H01R 27/02; H01R 33/90

[52] U.S. Cl. ..... 174/72 A; 174/71 R; 174/72 C; 439/650; 439/651

[58] Field of Search ..... 174/72 A, 71 R, 72 C; 439/34, 43, 148, 160, 197, 271, 350, 490, 592, 650, 660, 651

[56] References Cited

U.S. PATENT DOCUMENTS

| | | | |
|---|---|---|---|
| 2,933,550 | 4/1960 | Cole et al. | 174/71 R X |
| 3,004,170 | 10/1961 | Greenspan | 439/43 |
| 4,193,655 | 3/1980 | Herrmann, Jr. | 439/271 X |
| 4,386,820 | 6/1983 | Dola et al. | 439/651 |
| 4,502,744 | 3/1985 | Garnett et al. . | |
| 4,545,632 | 10/1985 | Maier et al. | 439/650 X |
| 4,707,043 | 11/1987 | Reed . | |
| 4,895,426 | 1/1990 | Pinson | 174/71 R X |
| 4,971,576 | 11/1990 | Thimmesch | 439/34 X |

FOREIGN PATENT DOCUMENTS

| | | | |
|---|---|---|---|
| 0218281 | 4/1987 | European Pat. Off. . | |
| 0509530 | 10/1930 | Germany . | |
| 0802882 | 2/1951 | Germany | 439/651 |
| 588376 | 5/1947 | United Kingdom | 439/660 |
| WO90/07814 | 7/1990 | WIPO . | |

*Primary Examiner*—Leo P. Picard
*Assistant Examiner*—H. S. Sough
*Attorney, Agent, or Firm*—Lowe, Price, Leblanc & Becker

[57] ABSTRACT

An electrical harness element comprises a multi conductor cable with power supply conductors and a signal conductor. At intervals along the cable, connectors in the form of sockets are fixed. The power supply conductors are continuous along the length of cable, but the signal conductor is interrupted at each socket by a series relay. The relay can be controlled by an electrical circuit, which is typically part of a sensor device which plugs into the socket. A number of the harness elements can be connected end to end as well as in branch configurations and are connected to a central computer. The relays are used to assist the central computer in addressing the sensor devices.

11 Claims, 3 Drawing Sheets

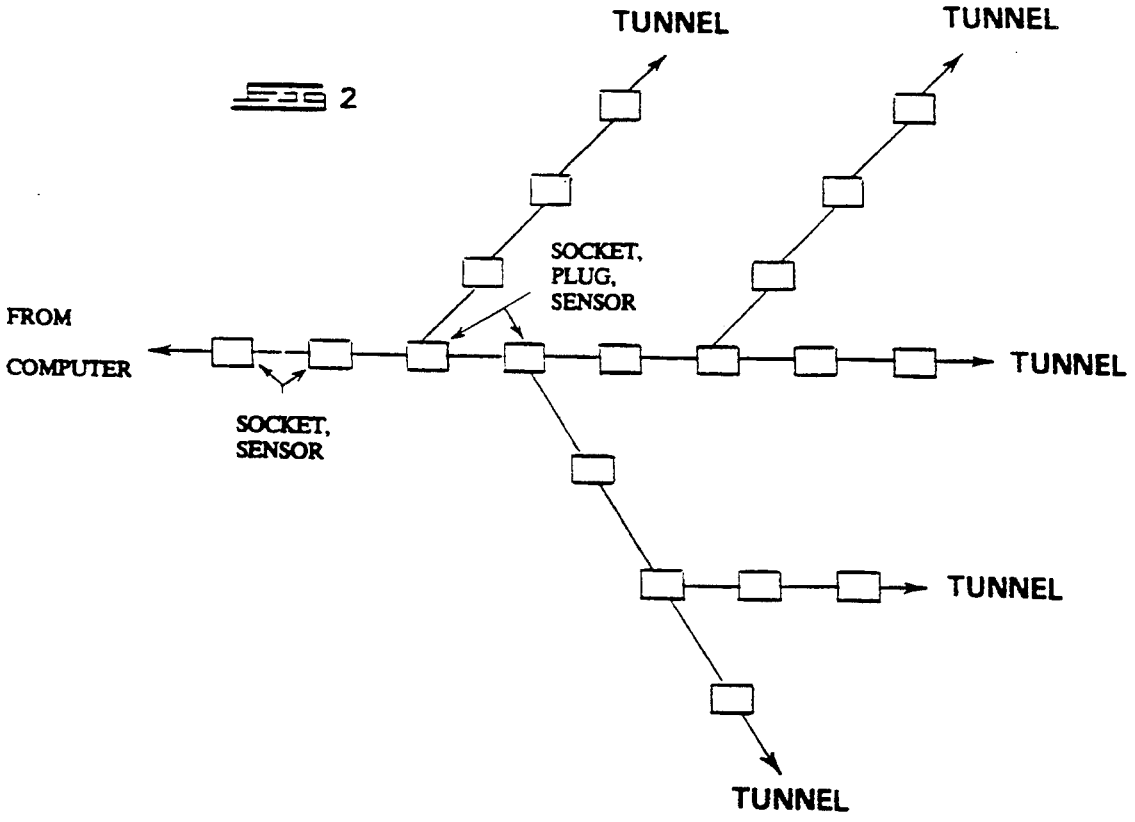
2
TUNNEL
TUNNEL
SOCKET,
PLUG,
SENSOR
FROM
COMPUTER
TUNNEL
SOCKET,
SENSOR
TUNNEL
TUNNEL
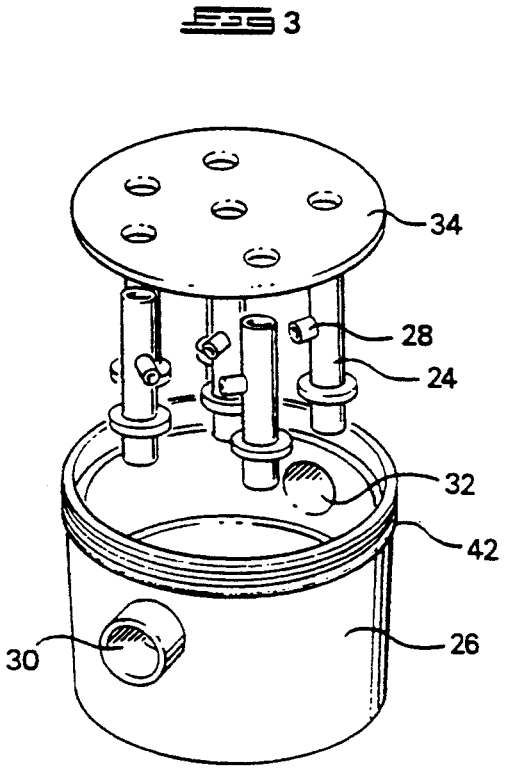
3
34
28
24
32
42
30
26
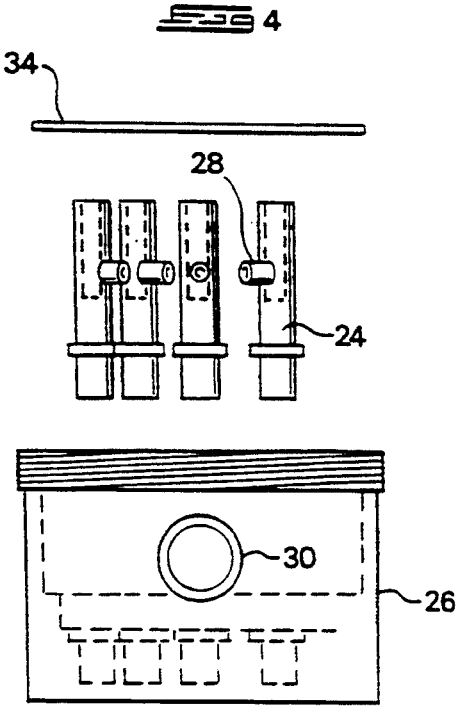
4
34
28
24
30
26

5
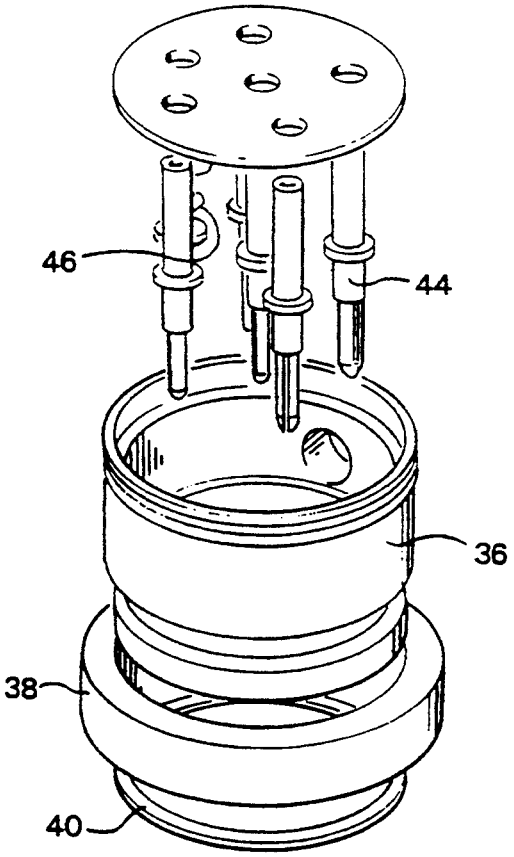
6
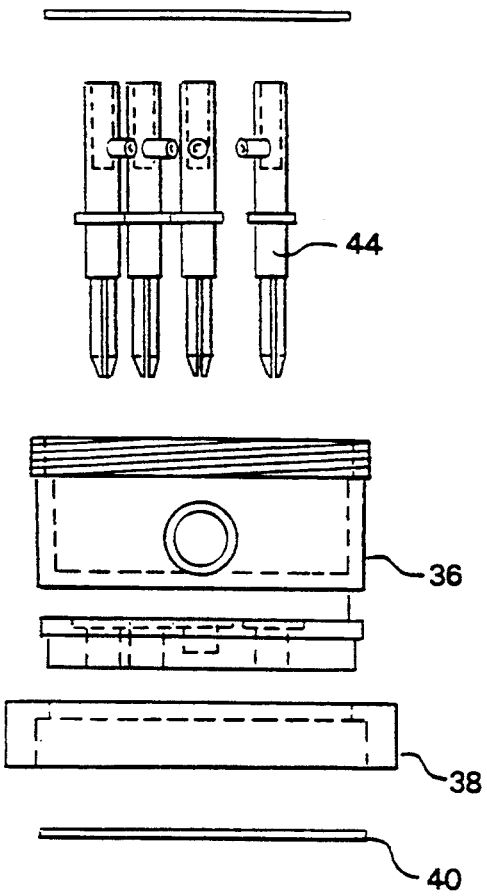
7
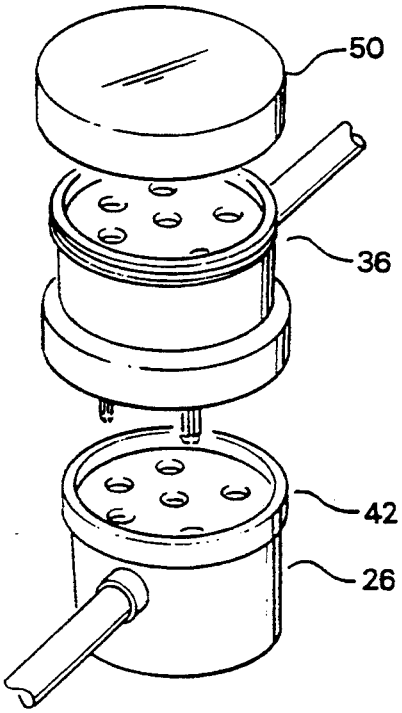

ELECTRICAL HARNESS SYSTEM

BACKGROUND OF THE INVENTION

This invention relates to an electrical harness element and to an electrical harness system including a number of the harness elements.

In hazardous environments such as underground mines, numerous sensors such as gas or smoke detectors are installed, as well as various monitoring devices for sophisticated equipment in use underground. Due to the great depth and considerable extent of many mines, the cost of the cabling required in an electrical harness system for such sensors and monitoring devices is high. Due to the harsh conditions in such an environment, such as periodic rock falls, high heat and humidity, the presence of corrosive chemicals and the risk of damage, for example, from carelessly driven underground vehicles, a harness system of this kind must be very rugged. This further increases the cost of the cabling required. Additionally, the need to extend and vary the layout of such harness systems creates a need for a convenient method of extending the cabling, which tends to be incompatible with robustness.

SUMMARY OF THE INVENTION

According to the invention an electrical harness element comprises a cable having at least first and second continuous conductors; at least a third conductor with a switch element in series therewith; and at least one connector means having respective contacts connected to the first and second conductors and to respective poles of the switch element in the third conductor; the connector means being adapted to allow an electrical circuit to be connected directly to the first and second conductors and selectively to the third conductor of the harness element.

The first and second conductors may be power supply conductors, and the third conductor may be a signal conductor.

Further conductors, continuous or including series switch elements, may be included in the harness element.

The harness element preferably includes a complemental plug and socket at respective ends thereof, to allow a plurality of the harness elements to be connected end to end.

The invention extends to an electrical harness system including a number of the harness elements connected end to end.

The harness system is typically used to connect a number of sensors or monitoring devices to a central control or monitoring station in a mine, for example.

BRIEF DESCRIPTION OF THE DRAWINGS

FIG. 2 shows a harness system incorporating a plurality of the harness elements of FIG. 1;

FIG. 3 is an exploded pictorial view of a socket of the harness element;

FIG. 4 is a side view of the socket of FIG. 3;

FIG. 5 is an exploded pictorial view of a plug of the harness element;

FIG. 6 is a side view of the plug of FIG. 5; and

FIG. 7 is a pictorial view showing how the plug of FIGS. 5 and 6 mates with the socket of FIGS. 3 and 4.

DESCRIPTION OF AN EMBODIMENT

Figure 1:
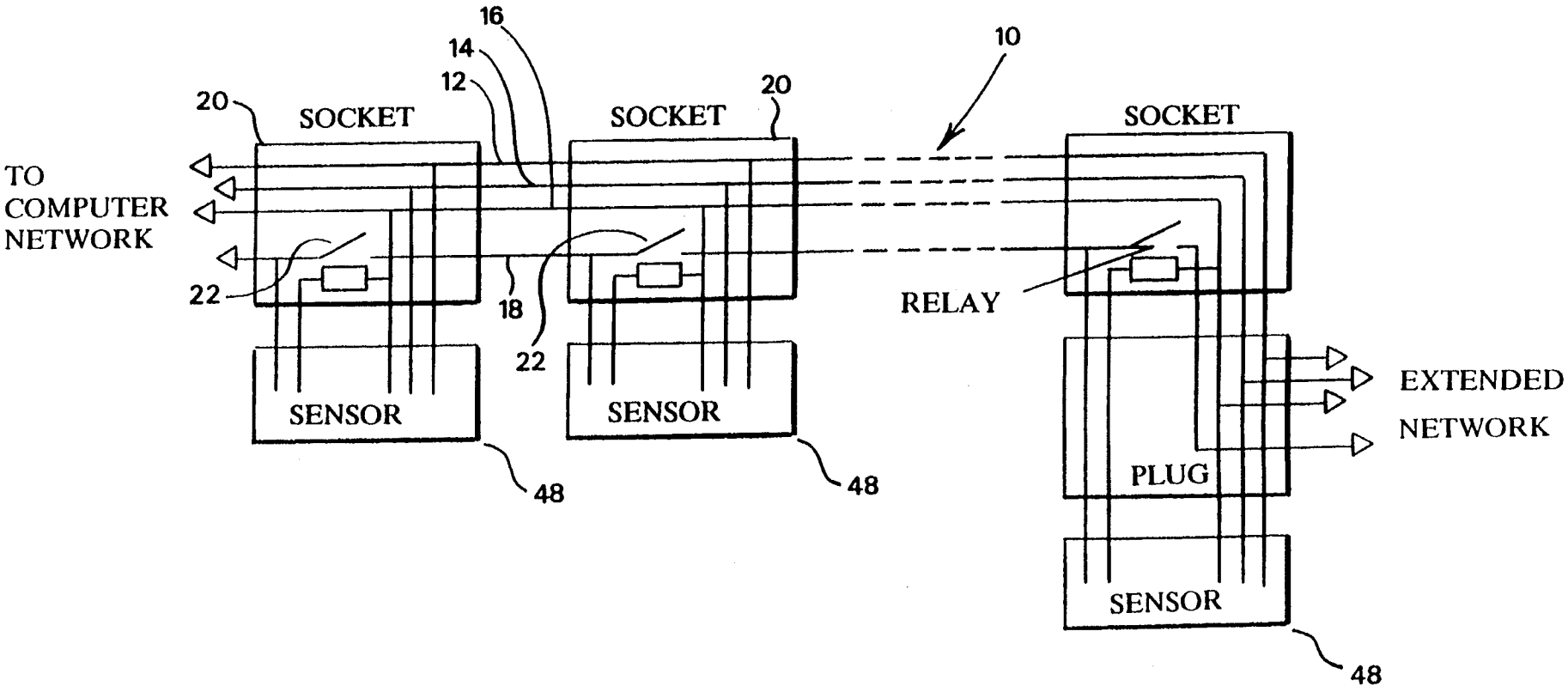
FIG. 1 is a schematic diagram showing a harness element according to the invention.

The harness element illustrated schematically in FIG. 1 comprises a multi-conductor armoured cable 10 which includes four electrical conductors 12, 14, 16 and 18. The conductors 12, 14 and 16 are continuous, while the conductor 18 is broken at each of a number of connector means in the form of sockets 20 fixed to the cable along its length. Normally-closed relays 22 connect the sections of the conductor 18, allowing it to be closed or interrupted selectively.

A typical socket is shown in FIG. 3 and is seen to include six tubular female connector elements 24 which are arranged asymmetrically in a cylindrical housing 26. Hollow spigots 28 on each connector 24 allow conductors of the cable 10 to be connected thereto as required. The cable 10 enters and leaves the housing 26 via opposed openings 30 and 32. Once the connectors 24 are wired to the correct conductors of the cable 10, they are fixed in position in the housing 26 with a potting compound, so that their open ends are approximately flush with the upper edge of the housing. An apertured disk 34 fits over the ends of the connectors and ensures their correct alignment.

In FIGS. 5 and 6, a plug is shown which is complemental to the socket shown in FIGS. 3 and 4. The plug also comprises a cylindrical housing 36 which is provided with a captive threaded collar 38 and a gasket 40. The thread of the collar 38 is complemental to a thread 42 formed on the upper edge of the housing 26 of the socket, allowing the housing 36 of the plug to be screwed on to the housing 26 of the socket. Within the housing 36 of the plug are a plurality of pins 44 which are aligned with the connectors 24 of the socket and which extend outwardly from the housing 36. Thus, when the housings 36 and 26 of the plug and socket are aligned and secured together by means of the collar 38, the respective pins 44 of the plug mate with the connectors 24 of the socket. Each pin 44 has a spigot 46 to allow connection of an electrical conductor thereto, and a similar cover plate to that used in the socket is used to ensure correct alignment of the pins, which are, again, potted in position with epoxy resin or the like.

The pins 44 have open tubular upper ends corresponding in shape to the connectors 24 of the socket, so that two plugs can be piggy-backed if necessary, and a sensor device can be fitted to a plug as well as to any socket. Instead of fitting the plug with an auxiliary socket, the end socket of the harness element could be provided with an auxiliary plug.

A plug as shown in FIGS. 5 and 6 is connected to one end of the harness element, while a socket as illustrated in FIGS. 3 and 4 is connected to the other end thereof, thus allowing a number of the harness elements to be connected together end to end, maintaining electrical continuity between the respective conductors. The asymmetrical arrangement of the pins and connectors of the plugs and sockets ensures correct alignment thereof when connecting them together.

In a typical version of the invention, the conductors 12, 14 and 16 serve as ground and power supply conductors, providing current to sensors or monitoring devices which are plugged into the sockets 20 along the length of the harness system. The conductor 18 serves as a signal line, allowing communication or control signals to be transmitted along the harness. The conductor 18 is controlled by the series contacts of the relays 22 and is normally connected through by the normally-closed contacts of the relays, but the contacts can be opened selectively by sending appropriate control signals via the conductor 18 to sensor devices 48 plugged into the respective sockets 20. The sensor devices 48 include interface circuitry responsive to the control signals to open or close the relay contacts as required. This feature enables the various sensors to be programmed with a unique identity by the central computer or monitoring station by isolating the sensors and then sequentially reconnecting them to the network for programming.

The provision of a number of sockets on each harness element allows the harness system to be branched, as shown in FIG. 2, since two or more further harness elements may be connected to each existing harness element.

The plugs and sockets described are formed from tough plastics material, and the potting of the pins and connectors of the plugs and sockets and the provision of screw-on collars and gaskets ensures robust waterproof connections between plugs and sockets. Also, the use of sturdy armoured cable increases the resistance of the harness system to damage. The extension of an existing harness system is a simple matter of adding further harness elements to the existing system. If it is necessary to plug an additional harness element into any particular socket of the harness system, the sensor 48 which had been plugged in to the socket in question can simply be fitted to the built-in socket of the plug itself, so that continuity of operation is obtained. When the harness system is re-configured in this way, the central computer or monitoring station can then make use of the relays in each socket to selectively isolate the sensors, thereby to re-identify each sensor.

If any socket is unused, it is simply sealed by means of a screw-on cap 50 to keep out dirt and moisture.

We claim:

1. An electrical harness element comprising a cable having at least first and second continuous power supply conductors; at least a third signal conductor with a switch element in series therewith; at least one connector means having respective contacts connected to the first and second conductors and to respective poles of the switch element in the third conductor, the connector means being adapted for connection of an electrical circuit module directly to the first and second conductors and selectively to the third conductor of the harness element; and a complemental plug and socket at respective ends of said cable to allow a plurality of the harness elements to be connected end to end, with at least one of the harness elements connected to a central station, and with a plurality of electrical circuit modules connected to selected connector means of respective harness elements, so that the central station and each electrical circuit module are directly electrically connected via the first and second conductors, to supply each electrical circuit module with electrical power, and selectively electrically connected via the third conductor and the switch element, to allow communication between the central control station and each electric circuit module.

2. An electrical harness element according to claim 1 wherein the plug and socket have complemental contacts which are arranged asymmetrically to prevent incorrect alignment thereof.

3. An electrical harness element according to claim 1 wherein at least one of the plug and the socket includes an auxiliary socket or plug, respectively.

4. An electrical harness element according to claim 3 wherein the plug includes an auxiliary socket which is compatible with the socket at the other end of the harness element.

5. An electrical harness element according to claim 4 wherein the at least one connector means comprises at least one socket compatible with the socket at the end of the harness element, so that the plug of one harness element can be plugged into a desired connector means of another harness element.

6. An electrical harness element according to claim 5 wherein each of the plugs, sockets and connector means comprises a housing adapted to mate sealingly with the housing of a complemental connector means.

7. An electrical harness element according to claim 1 wherein the switch element associated with each connector means is a relay.

8. An electrical harness element according to claim 7, further including an electrical circuit connected to the connector means, wherein the relay is controllable by the electrical circuit connected to the connector means.

9. An electrical harness element according to claim 8, further including a central control station, wherein the electrical circuit is responsive to control signals transmitted on the third conductor from the central control station, to open or close the relay contacts.

10. An electrical harness system including a plurality of interconnected harness elements according to claim 1.

11. An electrical harness system element according to claim 10 including a control station connected to at least one of the harness elements, the control station including a power source connectable to the first and second conductors, and an interface connectable to the third conductor for communication with electrical circuits connected to respective connector means of the harness elements.

* * * * *